US008888934B2

(12) United States Patent
Bian

(10) Patent No.: US 8,888,934 B2
(45) Date of Patent: Nov. 18, 2014

(54) METHOD FOR PRODUCING A FORMED STEEL PART HAVING A PREDOMINANTLY FERRITIC-BAINITIC STRUCTURE

(75) Inventor: Jian Bian, Moers (DE)
(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.
(21) Appl. No.: 12/991,216
(22) PCT Filed: Apr. 24, 2009
(86) PCT No.: PCT/EP2009/054961
§ 371 (c)(1),
(2), (4) Date: Jan. 24, 2011
(87) PCT Pub. No.: WO2009/135776
PCT Pub. Date: Nov. 12, 2009
(65) Prior Publication Data
US 2011/0132502 A1 Jun. 9, 2011
(30) Foreign Application Priority Data
May 6, 2008 (DE) ..... 10 2008 022 399
(51) Int. Cl.
*C21D 8/02* (2006.01)
*C21D 9/48* (2006.01)
(Continued)
(52) U.S. Cl.
CPC .. *C21D 9/48* (2013.01); *C21D 8/02* (2013.01); *C21D 1/185* (2013.01); *C21D 1/20* (2013.01);
(Continued)
(58) Field of Classification Search
CPC ..... C21D 8/02
USPC ..... 148/534, 653, 654
See application file for complete search history.

(56) References Cited

U.S. PATENT DOCUMENTS 4,426,235 A 1/1984 Sudo et al.
6,296,805 B1 10/2001 Laurent et al.
(Continued)

FOREIGN PATENT DOCUMENTS

DE 10208216 C1 3/2003
DE 102005054847 B3 10/2007
(Continued)

OTHER PUBLICATIONS

"Potentials for lightweight vehicle body construction", Tradefair Newsheet ThyssenKrupp Automotiv AG at 61st International Motor Show in Frankfurt, Sep. 15-25, 2005, 4 pages, Germany.
(Continued)

*Primary Examiner* — Brian Walck
(74) *Attorney, Agent, or Firm* — The Webb Law Firm

(57) ABSTRACT

In a method to produce formed steel parts a primary steel material is provided, which (in % by weight) comprises C: 0.02-0.6%, Mn: 0.5-2.0%, Al: 0.01-0.06%, Si: max. 0.4%, Cr: max. 1.2%, P: max. 0.035%, S: max. 0.035%, and optionally one or more of the elements of the "Ti, Cu, B, Mo, Ni, N" group, with the proviso that Ti: max. 0.05%, Cu: max. 0.01%, B: 0.0008-0.005%, Mo: max. 0.3%, Ni: max. 0.4%, N: max. 0.01%, and the remainder as iron and unavoidable impurities. The primary material is heated through at a heating temperature (TA) lying between the Ac1 and the Ac3 temperature, such that at best incomplete austenitising of the primary material takes place, is placed into a press-form tool and formed therein into the formed steel part. The formed steel part is then heated to a bainite forming temperature (TB), which is above the martensite starting temperature (MS), however below the pearlite transformation temperature of the steel. After cooling, it is maintained for an austernpering period (tB) at the bainite forming temperature (TB) in a substantially isothermic manner, until the foamed steel part has produced a structure consisting predominantly of ferrite and bainite, the martensite content thereof being <5%, wherein residual austenite contents of <10% may be present. The formed part is then cooled to room temperature.

17 Claims, 1 Drawing Sheet

(51) Int. Cl.

| | |
|---|---|
| ***C21D 1/18*** | (2006.01) |
| ***C21D 1/20*** | (2006.01) |
| ***C22C 38/04*** | (2006.01) |
| ***C22C 38/32*** | (2006.01) |

(52) U.S. Cl.

CPC ... *C21D 2211/002* (2013.01); *C21D 2211/005* (2013.01); *C22C 38/04* (2013.01); *C22C 38/32* (2013.01)

USPC ..... 148/534; 148/653; 148/654

(56) References Cited

U.S. PATENT DOCUMENTS

| | | | |
|---|---|---|---|
| 2004/0060623 | A1 | 4/2004 | Boke et al. |
| 2007/0107819 | A1 | 5/2007 | Gehringhoff et al. |
| 2008/0308194 | A1 | 12/2008 | Corquillet et al. |

FOREIGN PATENT DOCUMENTS

| | | | |
|---|---|---|---|
| DE | 102006053819 | A1 | 5/2008 |
| EP | 0971044 | A1 | 1/2000 |
| EP | 1767659 | A1 | 3/2007 |
| JP | 2006104526 | A | 4/2006 |

OTHER PUBLICATIONS

"Material data sheet for Material No. 1.5528 Designation 22MnB5", Steel Catalog, 2004, pp. 1-6, Verlag Stahlschlüssel, Germany.

Hein et al., "Status and Innovation Trends in Hot Stamping of USIBOR 1500 P", Steel Research International, 2008, pp. 85-91, vol. 79, No. 2, Verlag Stahleisen GmbH, Dusseldorf, Germany.

Lenze et al., "Herstellung von Karosseriebauteilen aus warmumgeformten höchstfesten Stahlwerkstoffen", EFB-Kolloquim, 2005, pp. 53-61, Europäische Forschungsgesellschaft für Blechverarbeitung, Germany.

Merklein et al., "Characterisation of the Flow Properties of the Quenchenable Ultra High Strength Steel 22MnB5", CIRP Annals, Jan. 1, 2006, 4 pages, vol. 55, No. 1, Technische Rundschau, Berne, Switzerland.

Srivastava et al., "Microstructural and mechanical characterization of C-Mn-Al-Si cold-rolled TRIP-aided steel", Materials Science and Engineering A, 2007, pp. 549-557, vol. 445-446.

De Cooman, "Structure-properties relationship in TRIP steels containing carbide-free bainite", Current Opinion in Solid State & Materials Science, 2004, pp. 285-303, vol. 8, No. 3-4.

Steinhoff et al., "Verbessertes Festigkeits-/Dehnungsverhältnis durch modifizierte Wärmebehandlung höchstfester Vergütungsstähle vom Typ 22MnB5", Neuere Entwicklungen in der Blechformung: Vortragstexte zur Veranstaltung, Inernationale Konferenz, May 9, 2006, pp. 185-203, Germany.

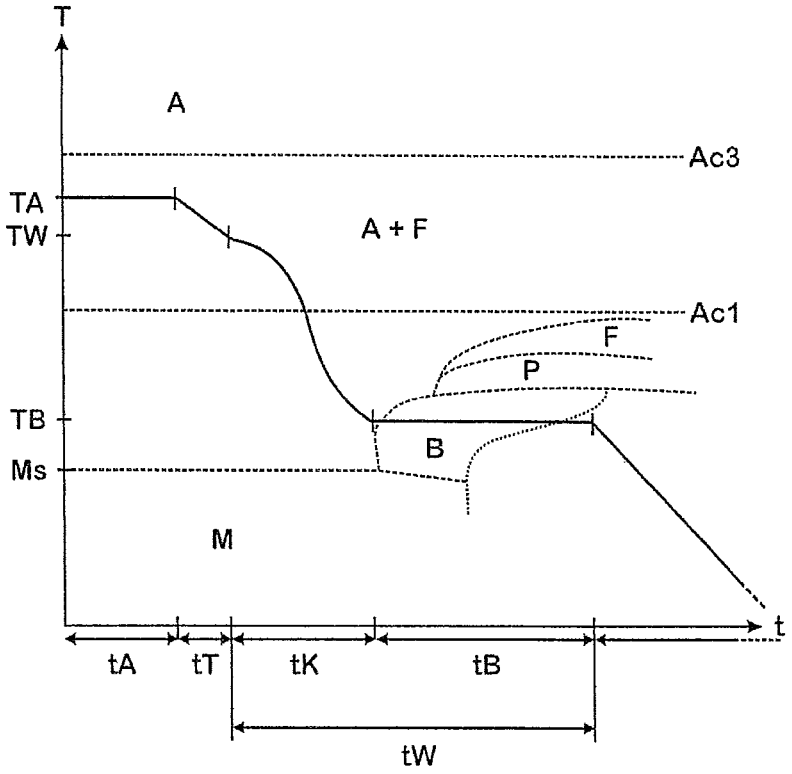
T
A
Ac3
TA
TW
A + F
Ac1
F
P
TB
B
Ms
M
t
tA
tT
tK
tB
tW

METHOD FOR PRODUCING A FORMED STEEL PART HAVING A PREDOMINANTLY FERRITIC-BAINITIC STRUCTURE

BACKGROUND OF THE INVENTION

1. Field of the Invention

The invention relates to a method for producing a formed steel part having a predominantly ferritic-bainitic structure.

2. Description of the Prior Art

In order to meet the demand in modern vehicle body construction for low weight combined with maximum strength and protection capacity, nowadays hot-press formed components, which are produced from high-strength steel, are used in such regions of the vehicle body, which in the event of a crash may be exposed to particularly high stresses. As examples of such formed steel parts A and B pillars, bumpers and door impact bars of automobile passenger vehicle are mentioned.

In hot-press hardening of steel blanks, which are slit from cold- or hot-rolled steel strip, the cut metal sheets concerned are heated to a deformation temperature usually above the austenitising temperature of the particular steel and placed in the heated state into the tool of a forming press. In the course of subsequent forming, the cut metal sheet or component formed thereof undergoes rapid cooling through contact with the cold tool, as a result of which hardened structure is produced in the component. In this case it may be sufficient if the component cools down without active cooling purely through contact with the tool. Fast cooling, however, can also be assisted if the tool itself is actively cooled down.

As reported in the article "Potentials for lightweight vehicle body construction", appearing in the trade fair newssheet of ThyssenKrupp Automotiv AG at the 61st International Motor Show 15-25 Sep. 2005, hot-press hardening is used in practice particularly for producing high-strength body components made of boron-alloyed steels. A typical example of such steel is the steel known under reference 22MnB5, which is to be found in the 2004 steel catalogue under material number 1.5528.

A steel comparable with steel 22MnB5 is known from JP 2006104526A. This known steel, apart from Fe and unavoidable impurities, contains (in % by weight) 0.05-0.55% C, max. 2% Si, 0.1-3% Mn, max. 0.1% P and max. 0.03% S. To increase the hardness, additionally amounts of 0.0002-0.005% B and 0.001-0.1% Ti can be added to the steel. In this case the particular Ti amount serves to bind the nitrogen contained in the steel. In this way the boron present in the steel can deploy its strength-enhancing effect to the maximum.

In accordance with JP 2006104526 A firstly sheets made of steel composed in this way are produced, which are then pre-heated to a temperature lying above the Ac3 temperature, typically in the range of 850-950° C. During subsequent rapid cooling from this temperature range in the pressing tool, the martensitic structure ensuring the desired high strengths is formed in the component press-formed from the respective cut metal sheet. In this case it is advantageous that the sheet metal parts heated to the temperature level mentioned can be transformed with relatively minimum deformation forces into complex shaped components. This is also valid in particular for such sheet metal parts as are produced from high-strength steel and provided with an anti-corrosive coating.

The components produced from boron-alloyed steels in the way described above reach strengths of over 1,500 MPa. However, as a consequence of the entirely martensitic structure of the components needed to do so, the components possess a residual elongation at break of 5-6%, which is not sufficient for many applications. The relatively low residual elongation at break is associated with low toughness. As regards applications, where good deformation behaviour is important in the event of a crash, this frequently leads to the situation where components produced from boron-alloyed steels in the known way no longer meet these requirements. This is the case in particular if the components being produced are parts for an automobile body.

In DE 10 2005 054 847 B3 it has been proposed, through subsequent heat treatment, to improve the crash behaviour of steel components produced by hot-press hardening which, apart from iron and unavoidable impurities, contain (in % by weight) 0.18-0.3% C, 0.1-0.7% Si, 1.0-2.50% Mn, max. 0.025% P, 0.1-0.8% Cr, 0.1-0.5% Mo, max. 0.01% S, 0.02-0.05% Ti, 0.002-0.005% B and 0.01-0.06% Al. In the course of the heat treatment, the hot-press hardened components are maintained at 320-400° C. Apart from the fact that such a heat treatment step can only be integrated at great expense in the established process chain for producing hot-press hardened steel components, practical trials have shown that the elongation at break of components heat-treated in this way worsens considerably.

Another possibility for producing a hardened metal component is known from DE 102 08 216 C1. With this known method a steel blank or pre-formed shaped component, which in each case consists of a steel of the type indicated above, is heated in a heating device to an austenitising temperature and then transported away to a hardening process. During the transport, sub-zones, of the first type, of the steel blank or shaped component, which should have higher ductility characteristics in the finished component, are quenched from a pre-determined cooling start temperature, lying above the $\gamma$-$\alpha$-transformation temperature. This quenching is terminated when a given cooling stop temperature is reached, and to be precise before transformation to ferrite and/or pearlite or after only minimal transformation to ferrite and/or pearlite has taken place. Subsequently the steel blank or respective formed part is maintained in an isothermic manner for transforming the austenite into ferrite and/or pearlite. Meanwhile in the zones of the second type which, by comparison, should have lower ductility characteristics in the finished component, the hardening temperature is maintained just high enough that sufficient martensite formation can take place in the zones of the second type during a hardening process. Finally, cooling down then takes place. Additionally, the formed part obtained in a separate process step is dipped into a quenching tank or similar in order to produce the desired martensitic hardness structure. Also this operation requires a process step that can be integrated only at great expense into a modern production plant. Furthermore, components produced according to this known method also present the problem that, although they possess high strength, they are at the same time so brittle that they do not meet the demands for formability required in practice.

SUMMARY OF THE INVENTION

Against the background of the prior art described above, the object of the invention consisted of indicating a method, whereby it is possible to produce formed steel parts in a simple process, in which high strength is combined with good residual elongation at break.

This object has been achieved according to the invention by the method indicated in claim 1. Advantageous variants of this method are indicated in the claims relating back to claim 1.

In accordance with the invention, a formed steel part having a predominantly ferritic-bainitic structure is produced.

For this purpose, a primary material in the shape of a steel blank or pre-formed steel part is provided. If a steel blank which has not yet been deformed is processed as primary material, the whole process is called "one-step" method. If, however, a pre-formed steel part is processed, this is termed a two-step process, wherein in the first step a steel blank which has not yet been deformed is formed such that the steel component obtained in this way has not yet reached its final shape.

The particular primary material according to the invention consists of a steel of a composition known per se, which apart from iron and unavoidable production-related impurities, contains (in % by weight) C: 0.02-0.6%, Mn: 0.5-2.0%, Al: 0.01-0.06%, Si: up to 0.4%, Cr: up to 1.2%, P: up to 0.035%, S: up to 0.035% and optionally one or more of the elements of the "Ti, B, Mo, Ni, Cu, N" group, wherein—if present as the case may be—Ti in an amount of up to 0.05%, Cu in an amount of up to 0.01%, B in amounts of 0.0008-0.005%, Mo in amounts of up to 0.3%, Ni in amounts of up to 0.4%, N in amounts of up to 0.01% are contained. Special importance regarding the strength of components produced according to the invention is thereby attributed to the specific C-content, whereas in particular the amounts of Si, Mn, Cr and Bare adjusted so that the formation of bainite is promoted and the emergence of larger martensite quantities in the structure of the component is avoided.

The primary material composed in this way (steel blank or pre-formed steel part) is heated through at a heating temperature lying between the Ac1 and the Ac3 temperature of the steel, such that incomplete austenitising of the primary material takes place. At the end of the austenitising phase, the structure of the primary material accordingly consists of ferrite and austenite.

Subsequently the primary material is placed into a press-form tool and formed therein into the formed steel part. In this case press hardening takes place within a temperature range in which the structure of the primary material is a two-phase mixture of ferrite and austenite.

Essence of the invention is now that the formed steel part is brought to a bainite forming temperature, which is above the martensite starting temperature, however below the pearlite transformation temperature of the steel, from which the steel blank or pre-formed steel part is produced in each case.

What is equally important is that as soon as this bainite forming temperature is reached, the formed steel part is maintained according to the invention for an austempering period at the bainite forming temperature in a substantially isothermic manner, until the formed steel part has produced a structure consisting predominantly of ferrite and bainite. The bainite forming temperature to be adjusted always depends on the bainite transformation temperature, which in each case is downwardly limited according to the chemical composition of the enriched austenite by the martensite starting temperature and upwardly limited by the pearlite transformation temperature.

The cooling rate during press hardening is considerably affected by the austenitising temperature and tool temperature. This must be so rapid that the steel blank is cooled down to the bainite forming temperature without any transformation and is constantly maintained at this temperature. By this approach it is achieved at the end of the austempering period that the formed steel part has a structure, which apart from the ferritic and bainitic structural amounts exhibits subordinated quantities of residual austenite and at most amounts of martensite below 5%. The residual austenite amounts can be up to 10%, mainly determined by the carbon content in the component obtained.

After the end of the austempering period, the formed steel part is cooled down to room temperature.

In accordance with the invention the temperature regime in respect to the austenitising process and subsequent press hardening is therefore controlled such that a mixed structure of ferrite, bainite and a portion of residual austenite is produced in the component. The inventive method therefore provides a steel component, the structure of which is characterised by a ferritic-bainitic microstructure. This bainitic microstructure confers improved deformation properties, in particular an improved residual elongation at break, on a component produced according to the invention. Associated with this, formed steel parts produced according to the invention have an improved crash behaviour, without separate tempering treatment being required to do so, since bainite can be regarded as a kind of tempered martensite.

In addition, the inventive method permits the steel component to cool down more slowly than with conventional methods, wherein cooling takes place in the tool with the aim of producing a martensitic hardened structure. Therefore, with an inventive method, the danger of component distortion occurring is minimised and the components produced according to the invention are characterised by particularly high dimensional accuracy. In order to guarantee slow cooling of the steel component, the pressing tool can also be heated in a controlled manner when executing the inventive method.

Apart from the advantages mentioned above, further advantages of the invention lie in the potential energy savings as a result of the comparatively low furnace temperature during austenitising, in reduced heat loading of any existing surface coating, in the use of Zn-coated primary material, feasible due to the lower furnace temperature during the austenitising, and also in that with the inventive method, by varying the austenitising temperature and tool temperature the mechanical parameters can be variably adjusted according to the demands on the component. Finally, formed steel parts produced according to the invention are also characterised by a high bake-hardening potential after press hardening.

In order to be able to exploit the advantageous characteristics obtained with the invention in a particularly reliable way, the ferrite and bainite portions in the structure of the formed steel part at the end of the austempering period should total at least 90%, wherein the individual ferrite and bainite portion should each be at least 30%.

Since martensite formation is prevented as completely as possible according to the invention, in principle it is advantageous if at the end of the austempering period the martensite portion of the formed steel part is less than 1%, in particular is limited to only traces.

Conventional MnB-steels and tempered steels are equally covered by the steel alloy of which the primary material to be processed according to the invention consists. A tempered steel particularly suitable for executing the inventive method, apart from iron and unavoidable impurities, comprises (in % by weight) C: 0.25-0.6%, Si: up to 0.4%, Mn: 0.5-2.0%, Cr: up to 0.6%, P: up to 0.02%, S: up to 0.01%, Al: 0.01-0.06%, Ti: up to 0.05%, Cu: up to 0.1% and B: 0.008-0.005%. By contrast MnB-steels coming under consideration for the inventive method comprise C: 0.25-0.6%, Si: up to 0.4%, Mn: 0.5-2.0%, Cr: up to 1.2%, P: up to 0.035%, S: up to 0.035%, Mo: up to 0.3%, Ni: up to 0.4% and Al: 0.01-0.06%.

Typically, the austenitising temperature of the steels from which primary material processed according to the invention is produced lies within the range of 750-810° C. In this case the heating period proposed for heating through at the heating temperature is usually within the time of 6-15 minutes.

In particular when producing formed steel parts which are intended for constructing vehicle bodies, in particular automobile bodies, it is advantageous if the primary material is provided with an anti-corrosion metal coating. This coating also protects the respective primary material (steel blank, pre-formed steel part) during transport from the furnace, in which it is pre-heated to the austenitising temperature, into the press-form tool. At the same time the anti-corrosive coating can be formulated so that it also prevents oxidation of the hot steel substrate due to atmospheric oxygen during transport in air.

A particularly practical variant of the inventive method is characterised in that press forming and bainitising of the steel component produced during press forming takes place in the press-form tool. Accordingly a particularly advantageous variant of the invention proposes that after the primary material has been press-formed, the formed steel part then obtained remains in the press-form tool and there is brought to the bainite forming temperature and maintained for the austempering period. Preferably the press-form tool is maintained at a temperature so that starting from a temperature above the bainite forming temperature the primary material has already cooled down to the bainite forming temperature during its press formation into the steel component. The tool closing time of the pressing tool, within which the shaping, cooling and bainitising of the formed steel part take place, in this case is usually 5-60 seconds, in particular 20-60 seconds.

If cooling to the bainite forming temperature and bainitising are carried out in a tool, the austempering period in each case is shorter than the tool closing time by the length of time required to bring the respective primary material to the bainite forming temperature.

Alternatively to bainitising in the press-form tool, it is also conceivable after press forming to remove the steel part press-formed out of the primary material from the mould and bring it in a separate process step to the bainite forming temperature and to maintain this for the austempering period. Such an approach may be employed if corresponding production means are available. Therefore, such an approach can be used for example if a salt or lead bath, to which the steel component can be taken after press forming, is available for heating to the bainite forming temperature and maintaining it.

The typical range of the bainite forming temperature, within which the inventive bainitisation is preferably carried out with the aim of producing a ferritic/bainitic structure, is typically downwardly limited by the martensite starting temperature of the respective steel composition of the primary material, while it can be upwardly adjusted in each case below 500° C., in order to avoid pearlite formation.

The procedural effort associated with executing the inventive method can also be reduced to a minimum if, after the end of the austempering period, the formed steel part obtained is cooled in a simple manner in air.

For executing the inventive method steel blanks that have been split from a hot-rolled or cold-rolled flat product, such as strip or sheet metal, are suitable. Likewise it is possible to use the inventive method on a steel part that has been pre-formed in a previous process step. The latter is the case for example if the shape of the steel component to be produced is so complex that a plurality of shaping steps are necessary for its production.

Due to their characteristic profile, steel components produced according to the invention are particularly suitable for use as automobile body parts that are critical in the event of a crash. The inventive method is particularly suitable for producing longitudinal and floor struts, which in practice should possess particularly good capacity to absorb energy.

BRIEF DESCRIPTION OF THE DRAWING

The appended drawing is a diagram plotting temperature against time showing the various phases present as a steel blank is transformed into a steel component according to a method of the present invention.

DETAILED DESCRIPTION OF THE INVENTION

The invention is described below in more detail on the basis of exemplary embodiments.

In the drawing, a typical course of the temperature T maintained during execution of an inventive method is plotted over the time t. Accordingly as primary material a steel blank in each case to be formed into a steel component, for example provided with an anti-corrosion AlSi coating, is first heated to an austenitising temperature TA, which lies below the Ac3 temperature, but above the Ac1 temperature, of the steel, from which the steel blank is produced in each case. The steel blank is maintained for a period tA at this austenitising temperature TA, until the steel blank is completely heated through, so that it consists of a mixed structure of austenite and ferrite. The zone in which the steel has a single structure is identified in the drawing by A, while the zone having the mixed structure of ferrite and austenite is identified as "A+F".

After the end of the austenitising period tA the steel blank is transported to a press-form tool. The transfer time needed until the press-form tool is closed is designated in the drawing by tT. The temperature TW, at which the steel blank arrives in the press-form tool, still lies within the temperature range Ac3–Ac1.

The press-form tool is equipped with a temperature-regulating device, which maintains it at a constant temperature corresponding to the bainite forming temperature TB. The steel shaped part formed from the steel blank and coming into direct contact with the press-form tool is cooled accordingly to the bainite forming temperature TB for a cooling period tK. In this case the bainite forming temperature TB is above the martensite starting temperature Ms, but below the pearlite transformation temperature. The region in which it starts to form pearlite is identified in the drawing by P. In addition the region that contains pure ferrite is identified in the drawing by F, and the region that contains martensite is identified as M.

As soon as the bainite forming temperature TB is reached, the steel component still held in the press-form tool is maintained for an austempering period tB at the bainite forming temperature TB in an isothermic manner. In this case the austempering period tB is limited such that, at its end, the austenitic structure of the steel component is essentially entirely transformed to a bainitic structure.

In this case the steel blank in the pressing tool maintained at a temperature is cooled within the cooling period tK so rapidly that the steel passes through the two-phase mixed zone A+F and transformation is prevented in the martensite zone M and pearlite zone P, whereas martensite formation is avoided as completely as possible.

After reaching the end of the austempering period tB, the tool is opened and the steel component is cooled down in static air to room temperature. The tool closing time tW comprising the cooling period tK and the austempering period tB is 5-60 seconds as a function of the complexity of the shape of the steel component to be produced and the sheet thickness of the steel blank being processed in each case.

For two experiments, two 1.5-2 mm thick steel blanks SP1, SP2 were produced by cold-rolling from a hot strip with a thickness of 3-4 mm, which steel blanks SP1, SP2 consisted of a 27MnCrB5-2 steel with the composition in % by weight shown in Table 1.

The first steel blank SP1 was then heated to an austenitising temperature TA of 780° C. and maintained at this temperature TA for an austenitising period tA of 6 minutes.

TABLE 1

| Remainder iron and unavoidable impurities | | | | |
|---|---|---|---|---|
| C | Si | Mn | P | S |
| 0.294 | 0.24 | 1.13 | 0.017 | 0.002 |
| Al | N | Cr | Ti | B |
| 0.035 | 0.0038 | 0.43 | 0.033 | 0.0010 |

Subsequently the steel blank SP1 was transported in air within a 6-12 second transfer time tT into a press-form tool, which was heated to a bainite forming temperature TB of 400° C. and constantly maintained at this temperature TB. The steel blank SP1 was then press-formed for a tool closing time tW of 40 seconds in the pressing tool. The total pressing time comprised the cooling period tK, in which the steel blank SP1 was cooled down from the tool entry temperature TW to the bainite forming temperature TB, and the austempering period tB, in which the bainite structure was produced in the steel component hot-press-formed in the press-form tool. Subsequently, the pressing tool was opened and the steel component was cooled down in static air to room temperature.

The structure of the formed steel part obtained in this way had a ferrite portion of 50%, a bainite portion of 40%, a residual austenite portion of 6% and a martensite portion of 4%.

In the second experiment, the second steel blank SP2 was heated through at an austenitising temperature TA of 800° C. such that it was also only incompletely austenitised. After this partial austenitising, the second steel blank SP2 underwent the same process steps as the first steel blank SP1.

The characteristics of the formed steel parts produced from the steel blanks SP1, SP2 in the way described above are indicated in Table 2.

TABLE 2

| Steel blank | TA [° C.] | Rp0.2 [MPa] | Rm [Mpa] | Ag [%] | A80 [%] |
|---|---|---|---|---|---|
| SP1 | 780 | 374 | 759 | 12.7 | 19.7 |
| SP2 | 800 | 464 | 802 | 11.4 | 19.0 |

Finally, for comparison a steel blank, likewise consisting of the 27MnCrB5-2-steel, was martensitically press-form hardened into a formed steel part in a conventional way. The residual elongation at break A80 in the case of the component obtained in this way was only approx. 6%. According to the discovered method, by contrast the residual elongation at break A80 of the same quality is approx. 19%.

Bainitic press hardening according to the invention therefore relates to a method for hot-press hardening wherein, in place of the martensite structure usually obtained, a structure predominantly consisting of ferrite and bainite is produced in the steel component press-formed in each case by isothermic transformation during press hardening. The ferritic/bainitic structure obtained has an improved residual elongation at break with high strength in comparison to martensite.

The invention claimed is:

1. A method for producing a formed steel part having a predominantly ferritic-bainitic structure, (a) providing a primary material in the shape of one of a steel blank or a pre-formed steel part, comprising in % by weight:

C: 0.02-0.6%,
Mn: 0.5-2.0%,
Al: 0.01-0.06%,
Si: max. 0.4%,
Cr: max. 1.2%,
P: max. 0.035%,
S: max. 0.035%, and optionally one or more of the elements from the group consisting of Ti, Cu, B, Mo, Ni, N, with the proviso that Ti: max. 0.05%,
Cu: max. 0.01%,
B: 0.0008-0.005%,
Mo: max. 0.3%,
Ni: max. 0.4%,
N: max. 0.01%, and the remainder as iron and unavoidable impurities;

(b) heating and maintaining the primary material at a heating temperature (TA) lying between an Ac1 and Ac3 temperature of the steel, such that the steel has a two-phase mixed structure of austenite and ferrite;

(c) placing the primary material having said two-phase mixed structure of austenite and ferrite into a press-form tool and press forming the primary material into the formed steel part;

(d) bringing the formed steel part to a bainite forming temperature (TB), which is above a martensite starting temperature (MS), however below a pearlite transformation temperature of the steel, from which the primary material is produced;

(e) maintaining the formed steel part at the bainite forming temperature (TB) for an austempering period (tB) in a substantially isothermic manner, thereby transforming austenite of said two-phase mixture to bainite while avoiding the transformation of austenite into martensite during step (e); and (f) cooling the formed steel part to room temperature after the end of the austempering period (tB), wherein a structure of the cooled steel part consists predominantly of ferrite and bainite, a martensite content thereof being less than 5%, and wherein residual austenite contents of up to 10% may be present.

2. The method according to claim 1, wherein the steel comprises:

C: 0.25-0.6%,
Si: max. 0.4%,
Mn: 0.5-2.0%,
Cr: max. 0.6%,
P: max. 0.02%,
S: max. 0.01%,
Al: 0.01-0.06%,
Ti: max. 0.05%,
Cu: max. 0.1%,
B: 0.0008-0.005% and the remainder as iron and unavoidable impurities.

3. The method according to claim 1, wherein the steel comprises:

C: 0.25-0.6%,
Si: max. 0.4%,
Mn: 0.5-2.0%,

Cr: max. 1.2%,
P: max. 0.035%,
S: max. 0.035%,
Mo: max. 0.3%,
Ni: max. 0.4%,
Al: 0.01-0.06%,
and the remainder as iron and unavoidable impurities.

4. The method according to claim 1, wherein the total of the ferrite and bainite portions in the structure of the formed steel part is at least 90% at the end of the austempering period (tB).

5. The method according to claim 1, wherein at the end of the austempering period (tB) the martensite portion of the formed steel part is less than 1%.

6. The method according to claim 1, wherein the austenitising temperature (TA) is 750-810° C.

7. The method according to claim 1, wherein a heating period (tA) for heating at the heating temperature (TA) in step (b) is 6-15 minutes.

8. The method according to claim 1, wherein the primary material is provided with an anti-corrosion metal coating.

9. The method according to claim 1, wherein after the primary material has been press-formed, the formed steel part obtained in the press-form tool is brought to the bainite forming temperature (TB) and maintained for the austempering period (tB) while in the press-form tool.

10. The method according to claim 9, wherein a tool closing time (tW) of the pressing tool is 5-60 seconds.

11. The method according to claim 10, wherein the austempering period (tB) is shorter than the tool closing time (tW).

12. The method according to claim 1, wherein after press forming, the formed steel part is removed from the press-form tool and brought in a separate process step to the bainite forming temperature (TB) and maintained for the austempering period (tB).

13. The method according to claim 1, wherein the bainite forming temperature (TB) is higher than the martensite starting temperature (MS) of the primary material composition and below 500° C.

14. The method according to claim 1, wherein step (f) the cooling of the formed steel part after the end of the austempering period (tB) is conducted in air.

15. The method according to claim 1, wherein the formed steel part is a component of an automobile body.

16. The method according to claim 1, wherein the steel includes one or more of the elements from the group consisting of Ti, Cu, B, Mo, Ni, N, with the proviso that Ti: max. 0.05%,
Cu: max. 0.01%,
B: 0.0008-0.005%,
Mo: max. 0.3%,
Ni: max. 0.4%,
N: max. 0.01%.

17. The method according to claim 10, wherein the tool closing time (tW) is 20-60 seconds.

* * * * *

UNITED STATES PATENT AND TRADEMARK OFFICE

CERTIFICATE OF CORRECTION

PATENT NO. : 8,888,934 B2
APPLICATION NO. : 12/991216
DATED : November 18, 2014
INVENTOR(S) : Jian Bian-Ing It is certified that error appears in the above-identified patent and that said Letters Patent is hereby corrected as shown below:

Title Page, Column 2, Item (57) Abstract, Line 17, delete "austernpering" and insert -- austempering --

Title Page, Column 2, Item (57) Abstract, Line 19, delete "foamed" and insert -- formed --

Signed and Sealed this
Seventeenth Day of March, 2015

Michelle K. Lee

Michelle K. Lee
*Director of the United States Patent and Trademark Office*